United States Patent [19]

Panayappan et al.

[11] 4,325,744

[45] Apr. 20, 1982

[54] METHOD AND COMPOSITION FOR CLEANING METAL SURFACES WITH A FILM-FORMING COMPOSITION

[75] Inventors: Ramanathan Panayappan, Potomac, Md.; David L. Venezky, Alexandria, Va.

[73] Assignee: The United States of America as represented by the Secretary of the Navy, Washington, D.C.

[21] Appl. No.: 172,348

[22] Filed: Jul. 25, 1980

[51] Int. Cl.[3] ..... B08B 7/00; C11D 3/37; C11D 7/32; C23G 5/00

[52] U.S. Cl. ..... 134/4; 134/3; 134/41; 252/82; 252/174.23; 252/174.24; 252/524; 252/527; 252/542; 252/546; 252/DIG. 2; 252/DIG. 3; 252/DIG. 11

[58] Field of Search ..... 134/4, 42, 3, 41; 252/82, 180, 174.23, 174.24, 524, 527, 542, 546, 142, DIG. 2, DIG. 3, DIG. 11, DIG. 14

[56] References Cited

U.S. PATENT DOCUMENTS

| | | | |
|---|---|---|---|
| 2,817,606 | 12/1957 | Barrett | 134/22 |
| 3,079,284 | 2/1963 | Boucher | 134/4 |
| 3,549,538 | 12/1970 | Jacklin | 252/82 |
| 3,627,686 | 12/1971 | Sabatelli | 252/527 |
| 3,708,436 | 1/1973 | Thompson | 252/527 |
| 3,729,423 | 4/1973 | Hirota | 252/142 |
| 3,970,594 | 7/1976 | Claybaugh | 252/524 |
| 4,085,060 | 4/1978 | Vassileff | 252/180 |

OTHER PUBLICATIONS

Kirk-Othmer Encyclopedia of Chemical Technology, vol. 6, pp. 21 & 22, 801 & 802, 1965.

Lange's Handbook of Chemistry, 12th Ed., 1979, pp. 5-56.

Handbook of Chemistry & Physics, 43rd Ed., Published by Chem. Rubber Publishing Co., Cleveland, Ohio, 1961, pp. 1476-1479.

*Primary Examiner*—Dennis L. Albrecht

*Attorney, Agent, or Firm*—Robert F. Beers; William T. Ellis; Daniel R. Zirker

[57] ABSTRACT

A method of cleaning metal surfaces, particularly irregularly shaped metal surfaces such as exist on a ship, wherein a thick aqueous solution of a water soluble polymer, preferably polyvinylpyrrolidone (PVP), and a chelating agent, is applied to a rusty metal surface as a thick paste, which gradually hardens into an encapsulating film during cleaning. After cleaning is complete, the film and the corrosion products are easily peeled from the clean surface and can be disposed of as solid waste.

7 Claims, 4 Drawing Figures

Figure 1:
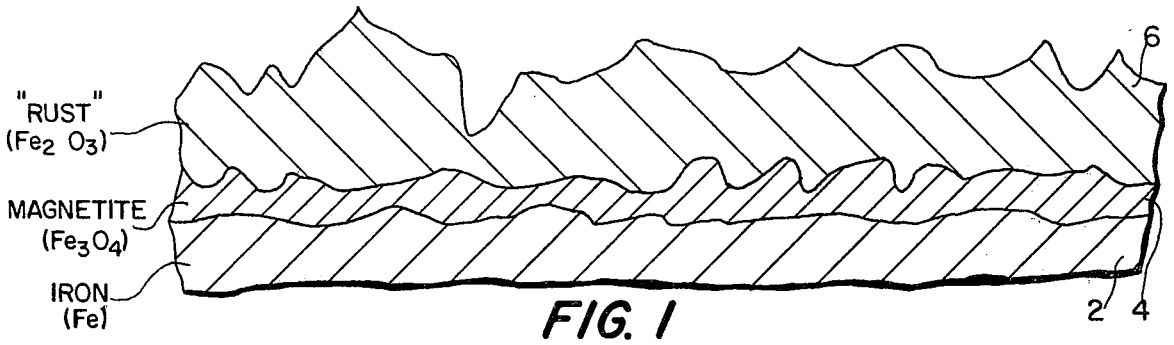

METHOD AND COMPOSITION FOR CLEANING METAL SURFACES WITH A FILM-FORMING COMPOSITION

BACKGROUND OF THE INVENTION

This invention relates to an improved method and composition for cleaning rusted metal surfaces and, more particularly, to an aqueous solution of a water-soluble polymer and a chelating agent, which forms a hard encapsulating film upon application to the metal surface to be cleaned and, after cleaning, is easily peeled away and disposed of.

The prior art has attempted to clean metal surfaces and, in particular, iron-based surfaces containing "rust", i.e., iron oxides such as $Fe_3O_4$ and $Fe_2O_3$, by the use of various acidic cleaning solutions. Chemicals such as inhibited hydrochloric acid, ethylenediaminetetraacetic acid (EDTA), EDTA/citric acid, and the like have been used to clean metal surfaces having rust and other scale-like deposits. Although very thin polymeric films have been used as long-lasting corrosion-inhibiting films on metal surfaces, they have not been used as a rust cleaner.

One particularly difficult type of metal surface to clean is the irregular surfaces found on ships, i.e., high-temperature valves, pipes, and the like. Frequently, the only cleaning method feasible is the lengthy and tiresome process of wire brushing the surface to be cleaned and then subsequently applying a solution of a wetting agent mixed with a cleaning agent to the metal surface. Such a technique suffers from the difficulty of keeping the cleaning fluid in contact with the surface to be cleaned, such as overhead objects, as well as the subsequent disposal of liquid wastes. Additionally, these solutions are often toxic, non-economical, and require large volumes of water for washing purposes.

SUMMARY OF THE INVENTION

This invention pertains to a novel method of cleaning rusty metal surfaces using a novel cleaning composition. The method comprises mixing an aqueous solution of an effective amount of a water-soluble polymer, such as PVP, with an effective amount of a chelating agent, such as EDTA, to form a thick paste, which is then applied onto the metal surface to be cleaned. When the cleaning formulation hardens into a thick crust, it encapsulates the corrosion products on the metal surface, and absorbs the corrosion products into a formed polymeric layer, which is eventually peeled from the cleaned surface and disposed of as solid waste.

The invention also is related to a novel cleaning solution comprising an effective amount of a water-soluble polymer, such as polyvinylpyrrolidone (PVP) and an effective amount of a chelating agent, such as EDTA, mixed with water to form an aqueous solution which, upon application to a metal having an oxide surface, forms a thick polymeric film which encapsulates the cleaning formation until the removal of the corrosion products from the metal surface is complete.

It is an object of this invention to develop a surface cleaning and pretreatment technology which insures the integrity of protective coatings.

It is another object of this invention to provide new cleaning chemicals which are safe, easy to apply, and clean the surface effectively.

It is still another object of the invention to provide a cleaning formulation which will effectively clean and protect metal surfaces prior to applying a final coating, is economical, nontoxic and easily disposable.

Other objects, advantages, and novel features of the invention will become apparent from the following detailed description of the invention when considered in conjunction with the accompanying drawings wherein:

FIG. 1 discloses a magnified schematic of an ordinary iron surface covered with iron oxide layers of $Fe_2O_3$ and $Fe_3O_4$.

Figure 2:
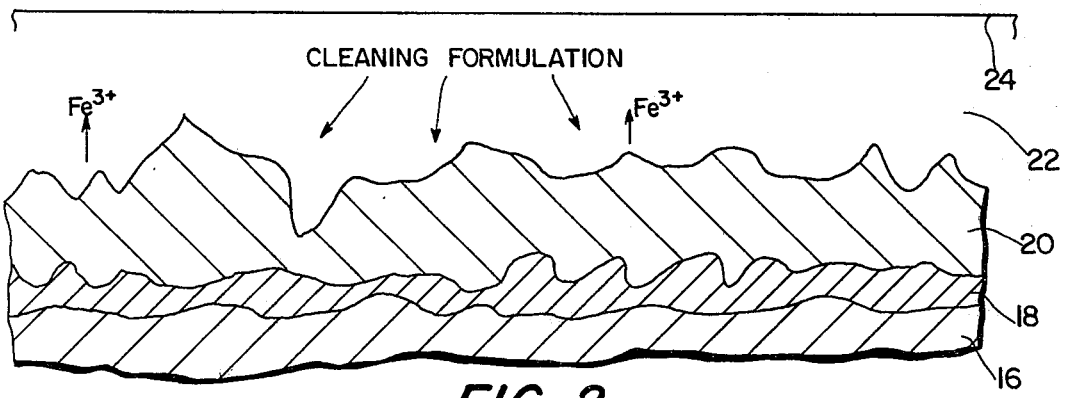

FIG. 2 discloses a later view of the surface of FIG. 1, shortly after the application of the film-forming cleaning solution.

Figure 3:
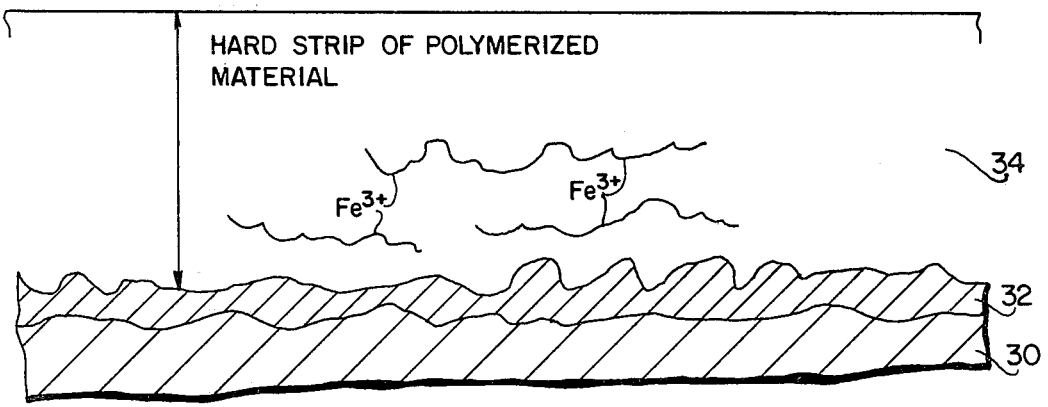

FIG. 3 discloses a still later view of the rusted surface, after the polymerized film has completely formed.

Figure 4:
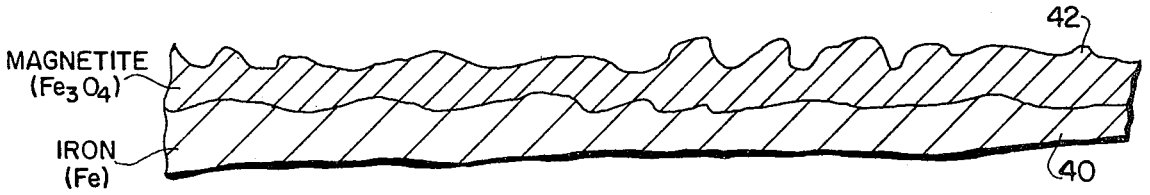

FIG. 4 discloses a final magnified view of the iron surface after completion of the cleaning and removal of the polymeric coating.

DESCRIPTION OF THE INVENTION

The chelating agents which are useful in this invention are those which are capable of forming a complex with metal, and particularly, iron ions. Examples of useful chelating agents are ethylenediaminetetraaceticacid (EDTA) and its tetrasodium salt, N, N, N', N'-tetrakis (2 hydroxypropyl) -ethylenediamine, triethanolamine, trimethylenediaminetetracetic acid, nitrilobispropionic acid, ethyleneglycol - bis-(beta-aminoethyl ether)-N, N-tetracetic acid, pentasodium salt of diethylenetriaminepentaacetate, trisodium salt of N- hydroxyethylethylenediaminetriacetate, iminodiacetic acid, hydroxyethyl-iminodiacetic acid and the like, as well as mixtures of these chelating agents. The chelating agents are used in an amount of about 1 to 10 weight percent of the entire solution, with EDTA being the preferred agent. The particular amount of cleaning composition is also influenced by the amount of rust present on the surfaces to be cleaned, the humidity of the environment, rate of water evaporation, as well as the temperature.

The water-soluble polymer suitable for the invention is any of the water soluble polymers which can engage in cross-linking with the iron ions present. Polyvinylpyrrolidone (PVP) is preferred, but other suitable polymers are any of the methacrylic or acrylic polymers, and the like. Although applicants do not wish to be bound by theory, it is believed that iron existing in different oxidized states engages in a chelating effect with the polar sections of the polymeric molecule, e.g.,

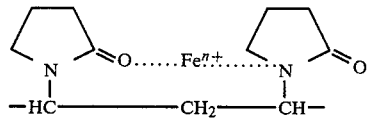

using PVP as an example. Feasible polymers of the invention have an average molecular weight of between 10,000 to 500,000. PVP K-90, a commercially available PVP of average mol. wt=360,000 sold by GAF, has been found to be a particularly suitable polymer. Various wetting agents can also be included in the composition with beneficial properties.

The process of the invention is best illustrated when viewed in light of FIGS. 1–4. FIG. 1 shows a diagram of a typical rusted metal surface, such as steel, aluminum, or any metal surface with an oxide coating, in the broadest embodiment of the invention. A typical iron surface usually comprises layer 2 of iron upon which a layer 4 of magnetite ($Fe_3O_4$) resides. A layer 6 of $Fe_2O_3$, or "rust" is generally positioned above the magnetite layer. In FIG. 2, iron surface 16 and iron oxide layers 18 and 20 are seen shortly after the application of the cleaning solution, which is applied in the form of a thick paste and allowed to harden for a period of 2 to 24 hours, preferably 8 to 12 hours. After initial application the cleaning composition divides into a solution of cleaning formulations 22 encapsulated by a thick, polymeric hard film 24. When the polymer employed is PVP, the weight used ranges between 5–30 wt. percent, and when EDTA is the chelating agent, between 1–10 wt. percent, and preferably 1–3 percent, is preferred. In FIG. 3, the cleaning system is observed near the end of the cleaning period, having metal layers 30 and magnetite layer 32 as before. The corrosion products however, have largely been removed, with a substantial portion of the iron ions having become crosslinked in layer 34, which has hardened into a thick strip of plastic material. Viewing FIG. 4, layer 34 has been peeled away, leaving only a clean metal surface 40 with a surface layer of magnetite 42.

The advantages of such a cleaning solution and technique are substantial. A metal surface now can be effectively and easily cleaned with a minimum of effort. Problems such as keeping the solution in contact with overhead walls, in-line valves and pipes, ease of disposal and freedom from dripping are easily solved. Additionally, this technique can be used for the protection of metal surfaces prior to the application of a final coating such as paint. Finally, these chemicals are both economical and non-toxic and the polymeric film formed can easily be disposed of as solid waste.

Obviously many modifications and variations of the present invention are possible in light of the above teachings. It is therefore to be understood that within the scope of the appended claims the invention may be practiced otherwise than as specifically described.

What is claimed and desired to be secured by letters patent of the United States is:

1. A method of cleaning a metal surface of deposit containing a metal oxide comprising:

forming an aqueous solution of a polyvinylpyrrolidone with an average molecular weight from about 10,000 to about 500,000, said solution having a polymer concentration at least sufficient to form a polymeric layer capable of removing said deposit and a chelating agent in an amount from about 1 to about 10 weight percent of said solution;

applying said solution onto said metal surface to be cleaned, whereby said solution forms a thick film layer which encapsulates said deposit on the metal surface;

allowing said layer to harden while cleaning occurs; and removing the said layer along with corrosion products said deposit from the said metal surface.

2. A method as claimed in claim 1 where said metal surface is a ferrous material.

3. The method of claim 1 wherein said aqueous solution comprises from about 5 to about 30 weight percent polyvinylpyrrolidone and from 1 to 3 weight percent of a chelating agent.

4. A method as claimed in claim 3 wherein said film is removed from the cleaned metal surface by peeling and subsequently disposed of as solid waste.

5. The method of claim 3 wherein said chelating agent is selected from the class consisting of ethylenediaminetetraacetic acid (EDTA), its tetrasodium salt, N, N, N', N'-tetrakis (2-hydroxypropyl) -ethylenediamine, triethanolamine, trimethylenediaminetetracetic acid, nitrilobispropionic acid, ethyleneglycol-bis(beta-aminoethyl ether)-N, N-tetracetic acid, pentasodium salt of diethylenetriaminepentaacetate, trisodium salt of N-hydroxyethylethylenediaminetriacetate, iminodiacetic acid, and hydroxyethyl-iminodiacetic acid.

6. The method of claim 5 wherein said chelating agent is ethylenediaminetetraacetic acid.

7. The method of claim 5 wherein said metal surface is a ferrous metal.

* * * * *